US006412454B1

(12) United States Patent
Green

(10) Patent No.: US 6,412,454 B1
(45) Date of Patent: Jul. 2, 2002

(54) ROTARY POWER UNIT

(75) Inventor: Edward Green, Eilat (IL)

(73) Assignee: Mapple Technology Limited, Guernsey (GB)

( * ) Notice: Subject to any disclaimer, the term of this patent is extended or adjusted under 35 U.S.C. 154(b) by 0 days.

(21) Appl. No.: 09/623,980

(22) PCT Filed: Feb. 3, 2000

(86) PCT No.: PCT/IL00/00068

§ 371 (c)(1),
(2), (4) Date: Oct. 5, 2000

(87) PCT Pub. No.: WO00/53925

PCT Pub. Date: Sep. 14, 2000

(30) Foreign Application Priority Data

Mar. 11, 1999 (IL) ..... 128934

(51) Int. Cl.[7] ..... F01B 1/04
(52) U.S. Cl. ..... 123/54.1
(58) Field of Search ..... 123/54.1

(56) References Cited

U.S. PATENT DOCUMENTS

| | | | | |
|---|---|---|---|---|
| 1,174,522 A | * | 3/1916 | Roots | 123/54.1 |
| 2,319,718 A | | 5/1943 | Brooks | |
| 2,345,125 A | | 3/1944 | Huber | |
| 2,789,515 A | | 4/1957 | Smith | |
| 3,407,707 A | | 10/1968 | Belliere | |
| 3,490,683 A | | 1/1970 | Kocher | |
| 3,871,793 A | | 3/1975 | Olson, Jr. | |
| 4,017,220 A | | 4/1977 | Hotine | |
| 4,541,781 A | | 9/1985 | Sheffer | |
| 4,616,604 A | * | 10/1986 | Ivanov et al. | 123/54.1 |
| 5,035,221 A | | 7/1991 | Martin | |
| 5,281,104 A | | 1/1994 | Bublitz | |
| 5,383,770 A | | 1/1995 | Hisahara | |
| 5,547,348 A | | 8/1996 | Riley et al. | |
| 5,634,777 A | | 6/1997 | Albertin et al. | |
| 5,636,599 A | * | 6/1997 | Russell | 123/54.1 |
| 5,765,512 A | * | 6/1998 | Fraser | 123/54.1 |
| 5,803,039 A | * | 9/1998 | Pien | 123/54.1 |

FOREIGN PATENT DOCUMENTS

| | | |
|---|---|---|
| DE | 1 503 356 | 1/1970 |
| DE | 27 30 632 A 1 | 1/1979 |
| EP | 358445 | 4/1930 |
| FR | 2 599 084 A 1 | 11/1987 |

* cited by examiner

*Primary Examiner*—Noah P. Kamen
*Assistant Examiner*—Jason Benton
(74) *Attorney, Agent, or Firm*—Oliff & Berridge, PLC

(57) ABSTRACT

A rotary power unit, comprising a housing having a circular opening and a plurality of bores extending along a radial axis from a center of the opening, a nodular rotor mounted within the opening of the housing and coaxially rotatable within the opening. The nodular rotor comprises a plurality of nodes equally distributed along the bounding circle thereof and the number of nodes is an odd integer less than the number of bores in the housing. A plurality of replaceable cylinder modules are fixedly receivable within a respective bore within the housing. Each cylinder module comprises a piston slidable within a cylinder, a piston actuating member associated with a each piston and a work unit associated with a cylinder head at a distal end the cylinder. Each piston is displaceable along the radial axis between a Top Dead Center (TDC) and a Bottom Dead Center (BDC), the pistons being biased into the BDC. The nodular rotor is fitted with a radial thrust reducing arrangement for engagement with respective piston actuating members.

31 Claims, 6 Drawing Sheets

ROTARY POWER UNIT

FIELD OF THE INVENTION

The present invention is in the field of rotary power units and in particular it is concerned with a radial, positive displacement power unit suitable for use as a fluid displacing device, namely a pump or a compressor, or as an engine.

BACKGROUND OF THE INVENTION AND PRIOR ART

The term "power unit" as used herein in the specification and claims is used to collectively refer to pumps, compressors and engines.

Radial power units have long been known. The general configuration with radial power units is a common shaft and one or more radially displaceable pistons adapted for performing pumping or compressing work or for generating work in case of an engine.

Among the advantages of radial power units is the essentially high volume stroke of the pistons within a relatively compact space. Furthermore, radial power units typically generate low noise level and require less maintenance than otherwise configured power units.

Many of the heretofore known rotary power units, in particular pumps and compressors, comprise an eccentric shaft engageable with one or more radially displaceable pistons. A drawback of this arrangement is that the development of undesired forces in the system, resulting in low performance of the power unit. Even more so, where eccentric assemblies are used, there is need to provide some balancing means in order to reduce forces developing in the system, which apart from increasing wear of the system, they might eventually lead to rupture of essential components of the unit.

Furthermore, prior art power units are typically of complex structure rendering them both non compact in size, heavy and being complex in their assembly. In addition, frequent maintenance is required owing to high wear of components and to lubrication requirements.

Still a disadvantage of prior art is the necessity of providing some speed reducing means intermediate a pump or compressor and an engine supplying rotary motion thereto. This arrangement obviously requires more space, is heavier and requires more maintenance.

A considerable disadvantage of prior art is low efficiency wherein essentially high rotational speed is required for delivering sufficient power or pumping/compressing volume, this owing mainly to a small ratio of piston diameter versus stroke.

Another disadvantage of prior art power units is the necessity to provide lubrication which in itself requires special circulation means, frequent servicing and there is always a possibility of lubricant entering the fluid being pumped or compressed. Power units in which lubrication is required, are typically not suitable for supplying gasses for critical applications such as supply of compressed gasses, e.g. oxygen for medical purposes, or other gasses, e.g. for diving or welding or for other industrial purposes.

Typically, a power unit is designed for a particular purpose such as a pump, a compressor or an engine and converting it from one function to another function is either practically impossible or, requires redesigning and changing of most of the essential components of the power unit, rendering it not cost effective. Even more so, a power unit is pre-designed to operate with fixed parameters such as fixed speed, diameter to stroke ratio, etc. These parameters are particularly fixed and are not variable, unless with some considerable modifications in the power unit.

At times, it is desired to increase a working capacity of a power unit, i.e. to increase its volume of fluid displacement in case of a pump or compressor, or to incorporate several power units to operate in conjunction with one another. Prior art power units are not designed to allow stacking of similar such units to one another with complete modularity.

U.S. Pat. No. 2,345,125 discloses a high pressure hydraulic pump in which a central shaft rotates an eccentric octagonal thrust block made of hardened steel, against which a plurality of bronze plunger heads are in sliding contact for displacing of a piston member within a cylinder.

U.S. Pat. No. 4,541,781 discloses a rotary fluid pump comprising rotating rollers running along a circular track for successively depressing a plurality of lever arms which in turn operate pistons in a like number of pumps. In this patent the centrifugal forces developing in the system are used to depress the rollers against the lever arms.

U.S. Pat. No. 5,547,348 discloses a rotor fitted with a primary eccentric rotatable with a shaft and a secondary eccentric adjustable in position relative to the primary eccentric and a plurality of radial piston cartridges are radially disposed around the shaft. This patent discloses stacking of such units however, transferring rotary motion between the stacked units is by a common shaft.

U.S. Pat. No. 5,634,777 discloses a radial piston machine wherein a rotor is formed with a primary eccentric rotatable around an axis and a secondary eccentric adjustable in position relative to the primary eccentric and a plurality of piston cartridges radially disposed around the axis. In this patent sliding friction shoes are provided for contacting the revolving eccentric.

Other prior art patents are U.S. Pat. Nos. 2,789,515, 3,407,707, 3,490,683, 3,871,793, 4,017,220, 5,035,221, 5,281,104, 5,383,770 and 5,547,348.

It is an object of the present invention to provide an improved power unit which, on the one hand, significantly reduces or overcomes the drawbacks of prior art power units and, on the other hand, improves the overall performances of the power unit.

SUMMARY OF THE INVENTION

In accordance with the present invention there is provided a rotary power unit, comprising:

- a housing having an circular opening and a plurality of bores, each extending along a radial axis from a center of said opening;
- a nodular rotor mounted within the opening of the housing and coaxially rotatable within the opening; said nodular rotor comprising a plurality of nodes equally distributed along the bounding circle thereof, the number of nodes being an odd integer less than the number of bores in the housing;
- a plurality of replaceable cylinder modules, each fixedly receivable within a respective bore within the housing;
- each cylinder module comprising a piston slidable within a cylinder, a piston actuating member associated with each piston and a work unit associated with a cylinder head at a distal end the cylinder; each piston being displaceable along the radial axis between a Top Dead Center (TDC) and a Bottom Dead Center (BDC), the pistons being biased into said BDC;
- and wherein the nodular rotor is fitted with a radial thrust reducing arrangement for engagement with respective piston actuating members.

The term "work unit" as used in the specification denotes a unit competent of performing work, e.g. a pumping unit, a compressing unit or a combustion chamber of an engine.

As it will become apparent hereinafter, the rotary power unit in accordance with the present invention significantly reduces wear of its components and consequently reduces maintenance requirements of the components. The power unit provides improved overall efficiency and uses an essentially short stroke versus a large diameter piston with low revolutionary speed on the one hand and, on the other hand, an essentially low linear speed of the pistons with respect to the cylinder wall.

The bottom surface of the piston actuators may be either flat, concave or convex, or may be of a complex shape comprising a combination of flat and arcuate segments. This arrangement is suitable for defining the up-stroke and down-stroke (these terms denote compression/suction displacement of the pistons in case of a pump or compressor or, discharge/intake displacement of the piston in case of an engine). This also permits control of the dwell time at the TDC of the piston which is an important parameter. In accordance with the present invention, within a single power unit, different piston actuators may be used wherein their bottom surfaces are either flat, concave, convex or a complex shape as above.

The dwell angle d of the piston at the BDC, measured in degrees of rotor rotation, is calculated by the formula:

$$d \geqq (360°/n)*0.125$$

where:

d is the dwell angle measured in degrees; and n is the number of nodes.

In accordance with the present invention, the piston is at the TDC when a corresponding node of the nodular rotor extends along the respective radial axis; and the piston is at its BDC when the respective node is angularly displaced by (180°/n)-d/2 from said radial axis;

wherein:

n—is the number of nodes of the modular rotor; and d—is the dwell angle between neighboring cylinders (measured in degrees).

In accordance with one embodiment of the present invention, the nodular rotor is associated with a shaft extending from the center of and perpendicular to the plane of the nodular rotor and adapted for receiving or imparting rotary motion to or from the nodular rotor, alternatively. However, the nodular rotor may be driven by a shaft extending into the housing or, in case of several housings stacked on top of one another, the nodular rotor may be rotated by coupling means adapted for simultaneous rotation of the nodular rotors.

In accordance with one aspect of the invention, the work unit is an assembly comprising one or more inlet valves and one or more outlet valves, and wherein rotary motion is imparted to the nodular rotor entailing radial displacement of the piston, thereby establishing a pump or compressor.

In accordance with another aspect of the present invention the work unit is an assembly comprising a fuel supply nozzle, ignition and ignition timing arrangements, and gas exchange passages; wherein radial displacement of the pistons imparts rotary motion to the nodular rotor, thereby establishing a radial engine.

There may also be a combined version of the above aspects, wherein the work unit of some of the cylinder modules is an assembly comprising one or more inlet valves and one or more outlet valves; and the work unit of the remaining cylinder modules is an assembly comprising a fuel supply nozzle, an ignition member and gas exchange passages.

In accordance with a most preferred embodiment, the nodular rotor is associated with a speed reducing assembly. In accordance, with one application, the speed reducing assembly is a planetary gear train, said planetary gear train comprising a sun gear fixed to the shaft, at least one planet gear rotatably supported by the housing, and a ring gear associated with the nodular rotor. In accordance with a different application, the speed reducing assembly is a planetary gear train, said planetary gear train comprising a sun gear fixed to the shaft, at least one planet gear rotatably fixed to the nodular rotor, and a ring gear fixed to the housing.

The piston actuating member may be integral with or rigidly fixed to the piston, with a bottom surface of the piston actuating member adapted for engagement with the nodes of the nodular rotor. The radial distance between the piston and the piston actuator is preferable adjustable, thereby entailing adjusting the clearance of the piston within the cylinder.

In order to reduce wear of mechanical components, to ensure smooth, quiet and efficient performance of the power unit, there is provided a radial thrust reducing arrangement which in accordance with one embodiment is a roller fitted at each node, each roller being rotatable about an axle parallel to an axis of rotation of the nodular rotor.

In accordance with a preferred embodiment, the radial thrust reducing arrangement is a roller having a geared portion fitted on each node for engagement with a geared ring fixed within the opening of the housing, thus imparting the rollers positive rotation about their longitudinal axis. In accordance with this embodiment, the rollers are continuously rotated about their axis and thus as they engage the bottom surface of the piston actuating member, they continue rolling, eliminating radial thrust.

For improved efficiency of the power unit, the cylinder modules are rotationally restrained within their bores. Furthermore, sealing rings are provided on the pistons and still preferably, rider rings are provided on the actuating member slidable within the cylinder module.

In accordance with one embodiment, there is provided a multiple power unit wherein the opening within the housing comprises a plurality of bores arranged in two or more parallel planes; each bore extending along a radial axis from said opening.

Alternatively, two or more housings are coaxially stacked on top of one another in parallel planes, whereby rotary motion is transferred between nodular rotors of neighboring housings.

Where the rotary power unit comprises more than two planes of cylinders, then it is desired that the centers of bores in one plane are angularly offset with respect to centers of bores in a neighboring plane by $\alpha°$, wherein $\alpha$ is derived out of the formula:

$$\alpha° = (360/N)/p$$

wherein:

$\alpha$ is measured in degrees;

N is the number of cylinders in each plane; and

P is the number of planes.

When the bores are angularly offset, as above, then continuous, sequential pumping or compressing effect is obtained.

In accordance with a different arrangement, one or more planes of a multi-stage rotary power unit are dedicated to establishing a pump or compressor, and one or more other planes are dedicated to establish a radial engine. However, there may also be provided an arrangement wherein some of the bores comprise one or more inlet valves and one or more outlet valves, and remaining bores are fitted with a fuel supply nozzle, ignition and ignition timing arrangements, and gas exchange passages, whereby a combined radial engine and a pump or compressor is established.

An important character of the power unit in accordance with the present invention is that the nodular rotor is adapted for both clockwise and counter-clockwise rotation and no particular adapting procedure is required. Accordingly, at any stage the nodular rotor may be reversed in direction or rotation.

In accordance with some preferred configurations, the curvature ratio between the diameter of the opening in the housing and a theoretical spherical diameter of the convex or the concave surface is in the order of about 1:1 to about 1:4. Still preferably the piston has a diameter to stroke ratio being greater than or equal to about 5:1 and where the nodular rotor is rotated at about 300 RPM, or less.

BRIEF DESCRIPTION OF THE DRAWINGS

In order to understand the invention and to see how it may be carried out in practice, some preferred embodiments will now be described, by way of non-limiting examples only, with reference to the accompanying drawings, in which.

DETAILED DESCRIPTION OF PREFERRED EMBODIMENTS

Figure 1:
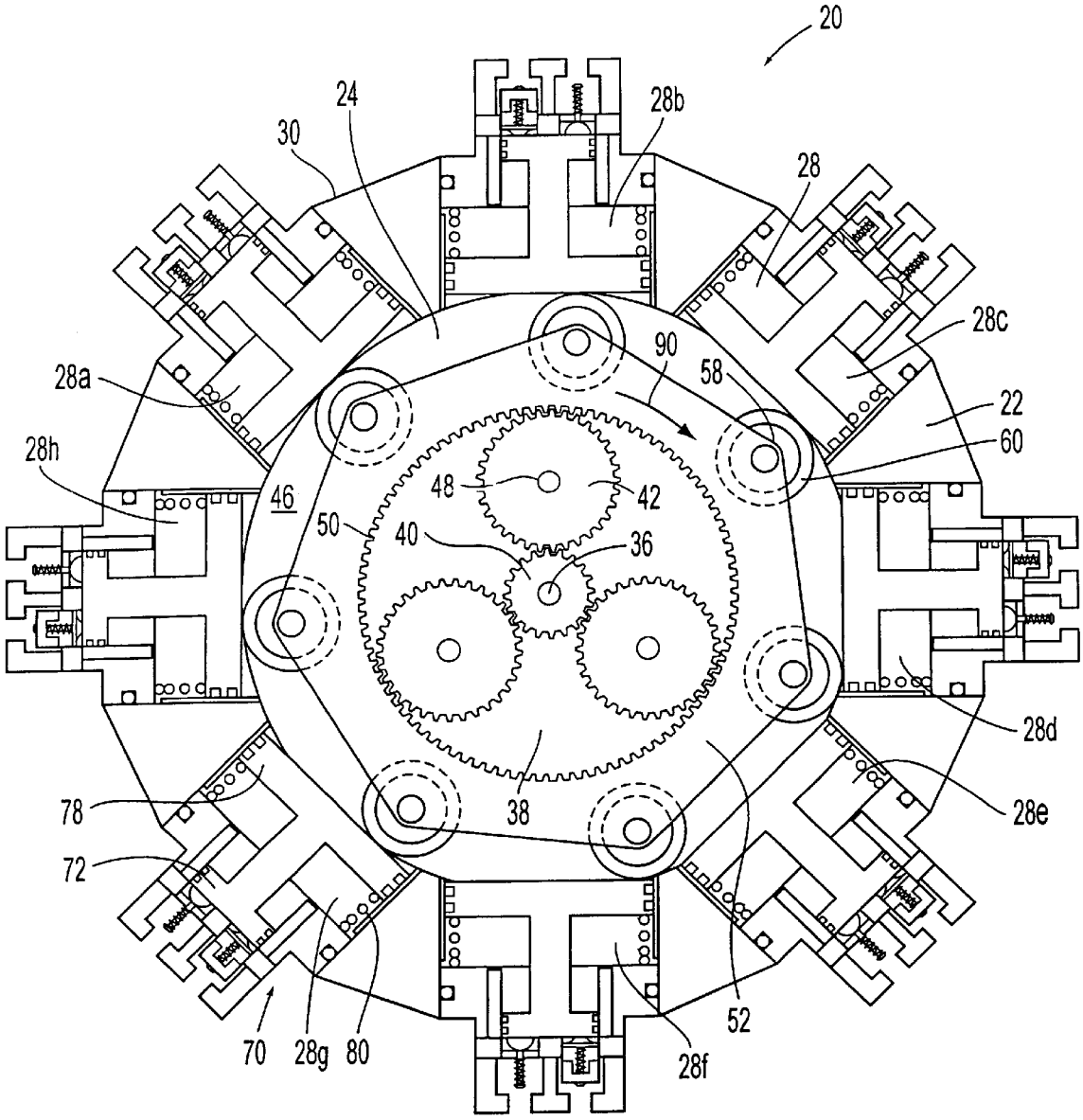
FIG. 1 is a schematical, planar view of a power unit in accordance with a first embodiment of the present invention, the power unit being a pump or compressor.

Attention is first directed to FIG. 1 of the drawings in which the power unit generally designated 20 is illustrated. In the present example, power unit 20 is a compressor or pump. However, as will become apparent hereinafter, it may be easily converted into an engine or, in accordance with an embodiment of the invention may be a hybrid engine and pump/compressor.

Power unit 20 has a generally cylindrical housing 22 formed with a central, circular opening 24 and a plurality of bores 28, radially extending between opening 24 to an external surface 30 of the housing 22, the bores penetrating into the circular opening 24.

In the present example, housing 20 is formed with eight bores. However, a different number of bores may be elected as well. Preferably, the number of bores is an even number.

Extending into opening 24 there is a shaft 36 associated with a planetary speed reducing gear train generally designated 38 and consisting of a sun gear 40 fixed to shaft 36, three planet gears 42 rotatably supported to wall 46 of opening 24 by means of shafts 48. Ring gear 50 constitutes an integral portion of a nodular rotor generally designated 52.

The artisan will appreciate that whilst in the present embodiment the planet gears are rotatably supported to the housing, there may be a different embodiment in which the planet gears are rotatably fixed to the gearing of the nodular rotor 52 and the ring gear is fixed to the housing.

Nodular rotor 52 is a heptahedron shaped member coaxially mounted within opening 24 and comprising seven nodes 58. Each node 58 rotatably supports a roller 60 adapted for rotating within the opening 24 about a circular path generated by a bounding circle of the bores 28. The arrangement is such that when a roller 60 is radially aligned with a longitudinal axis of a respective bore (bore 28*a* in FIG. 1) it penetrates to a maximum into that specific bore, entailing maximum displacement of the associated piston as will become apparent hereinafter. On the other hand, when the roller 60 is not in the vicinity of a bore (see bore 28*e* in FIG. 1) then the piston is in its lowermost, non-displaced position, as will be explained hereinafter.

Each of the bores 28 accommodates a cylinder module generally designated 70 which in the present example is a pump/compressor module..

Figure 2A:
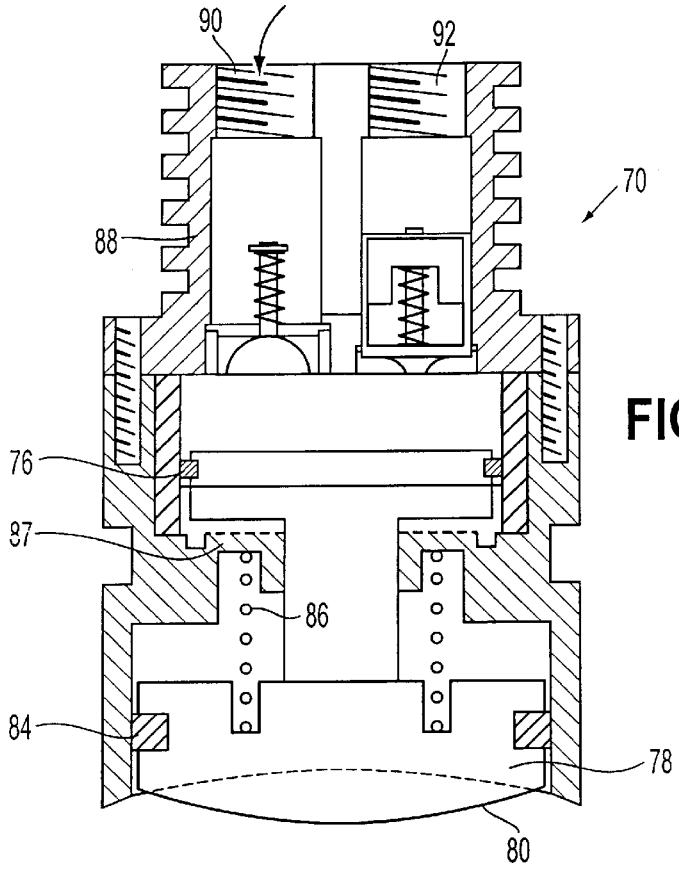
FIGS. 2A and 2B illustrate a piston module seen in FIG. 1, in two consecutive pumping/compressing steps.
Figure 2B:
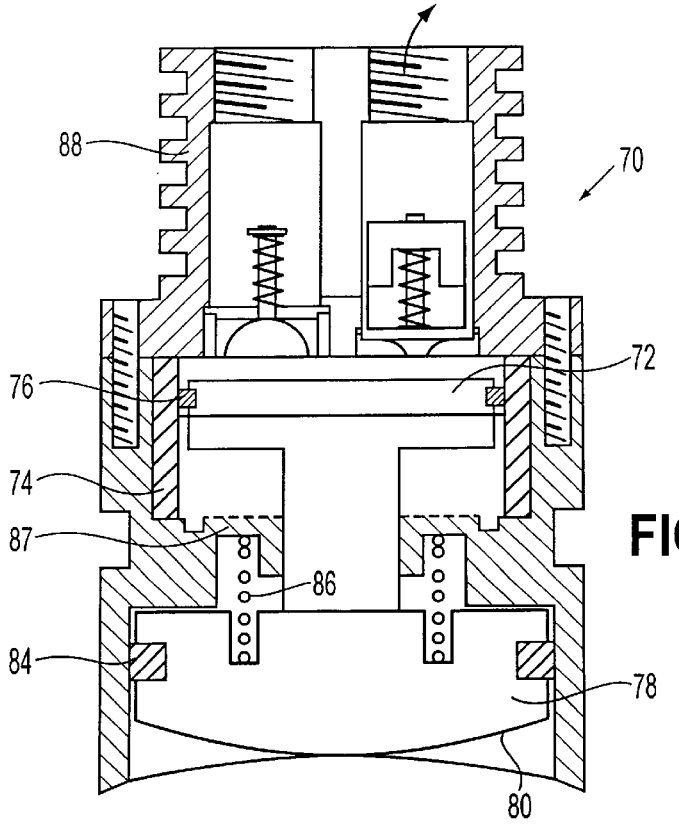

With further reference being made also to FIGS. 2A and 2B, the cylinder module 70 comprises a piston 72 slidably received within a cylinder sleeve insert 74 with suitable sealing rings 76 provided on the piston, as known per se. However, it should be noted that by other embodiments, cylinder sleeves are omitted.

A piston actuating member 78 is rigidly fixed or integrally formed with piston 72 and comprises a bottom surface 80, adapted for engagement with the nodes of the nodular rotor, as will hereinafter be explained. In order to provide smooth operation and to retain the piston and piston actuator aligned within the bore 28, the piston actuator 78 is fitted with rider rings 84. By a different embodiment (not illustrated) the linear distance between the piston and the associated piston actuating member may be altered for controlling the clearance of the piston from the piston head. This might be accomplished, for example, by providing screw-coupling engagements between the two members or by other means.

In the present example, sealing rings 76 are self-lubricant rings made of PTFE comprising about 15% graphite, whereby no liquid lubrication is required. However, other lubrication means are possible too.

Piston module 70 further comprises a coiled spring 86 bearing at one end thereof against a recessed shoulder 87 integrally formed within the wall of the piston module and at an opposed end thereof spring 86 bears against the piston actuator 78, thus biasing the piston and piston actuating member into a BDC position, i.e. the position in which the piston is radially inwardly biased (see FIG. 2A). The piston module 70 is easily insertable and fixed within a bore of the housing, with suitable fixing means provided (not shown), for fixingly securing the module within the housing.

Piston module 70 is further fitted with an inlet valve 90 and an outlet valve 92. FIG. 2A illustrates a pumping stroke and FIG. 2B illustrates a compression stroke. It is noted that in these figures the bottom surface of the piston actuating member is convex.

Figure 3:
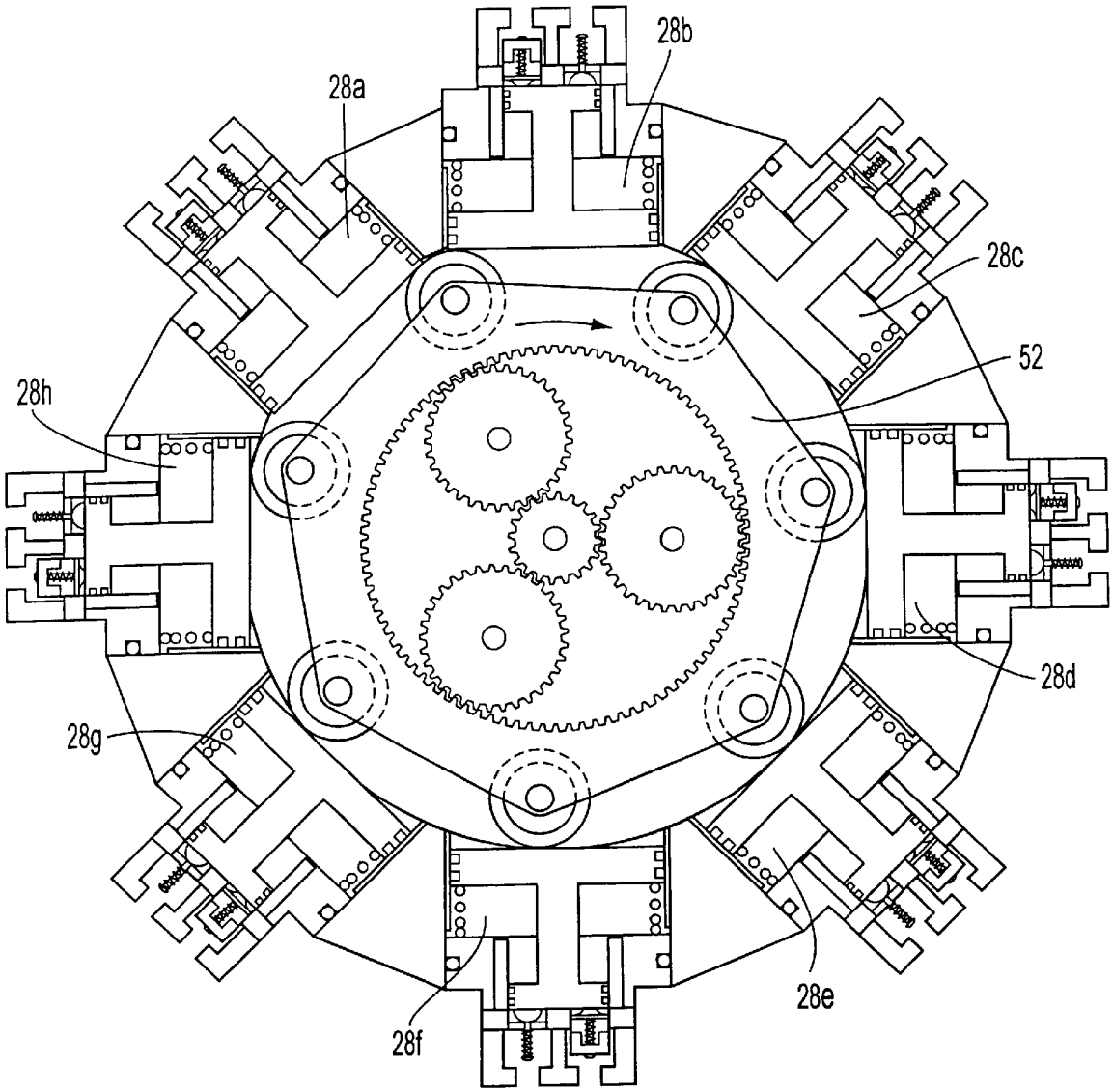
FIG. 3 is similar to FIG. 1 illustrating the pump/compressor after the modular rotor has rotated into a position in which the pistons have completed a single stroke.

Further attention is now directed to FIGS. 1 and 3 for understanding the sequential operation of a power unit in accordance with the present invention. In FIG. 1, the piston module seen in bore 28*a* is in a top dead center (TDC) whilst the piston module in bore 28*e* is in the bottom dead center (BDC). Considering that the nodular rotor 52 is now rotating in a clockwise direction represented by arrow 90, thus the pistons received within bores 28*b*, 28*c* and 28*d* are in consecutive inlet displacements, i.e. towards their BDC position. However the piston modules received within bores 28*f*, 28*g* and 28*h* are represented in consecutive displacements towards their top dead center, i.e. an outlet stroke.

In FIG. 3 the nodular rotor 52 is illustrated after rotating by 22.5°, wherein the piton module within bore 28*a* is now in its bottom dead center position whereas the piston module in bore 28*e* is in its top dead center. The piston modules received within bores 28*b*–28*d* are now illustrated in displacement towards a top dead center whereas piston modules received within bores 28*f*–28*h* are in displacement towards bottom dead center.

The arrangement in the present embodiment is such that the centers of bores are offset from other by 45° whereas the seven nodes are spaced from one another by about 51.4°. However, by changing the number of bores and the number of nodes, performances of the power unit are changed.

In the embodiments shown in the preceding figures, the piston actuator members 78 are illustrated with essentially flat bottom surfaces 80. However, it will be appreciated that these surfaces may also be concave or convex (as illustrated in FIGS. 2) or may have a complex surface shape comprising a combination of flat and arcuate segments. In this way, it is possible to displace the piston towards the BDC at one speed pattern and towards the TDC in another speed pattern, and to extend or shorten the dwell time, depending on viscosity of a fluid being pumped or compressed, as may be the case.

It will also be appreciated that while the piston modules described in the figures refer only to pumping/compressing modules, the power unit may also constitute an engine. For this purpose the piston modules are fitted with a fuel supply system, fuel ignition and timing means, gas exchange valves, etc., as known in the art.

If desired, a hybrid engine and pump/compressor may be engineered, wherein one housing accommodates several engine piston modules and several pump/compressor piston modules. However, owing to the simplicity of the device according to the invention, and to the extreme modularity, each of the piston modules may be replaced at any time to either a pumping piston module, a compression piston module or an engine piston module. In this manner, any combination of piston modules is acceptable and if required, some piston modules may also be eliminated altogether.

In accordance with modifications of the invention, the speed reducing planetary train may be an independent unit not associated within the housing. In this way the weight of the unit is reduced. Other speed reducing arrangements are also possible, as known.

An important feature of the power unit in accordance with the present invention is the radial thrust reducing arrangement which in the embodiment of FIGS. 1 and 3 was obtained by rollers 60. Further attention is now directed to FIG. 4 of the drawings, illustrating a different embodiment. In accordance with this embodiment, the power unit generally designated 100 comprises an internally geared ring 102 secured within a suitable recess 104 in housing 106 and the nodular rotor, generally designated 108 comprises a plurality of cylindrical rollers 110 axially and rotatably supported between two plates 112 and 114. Each roller 110 is formed with a geared portion 116 which is either integral with or fixedly attached thereto.

Figure 5:
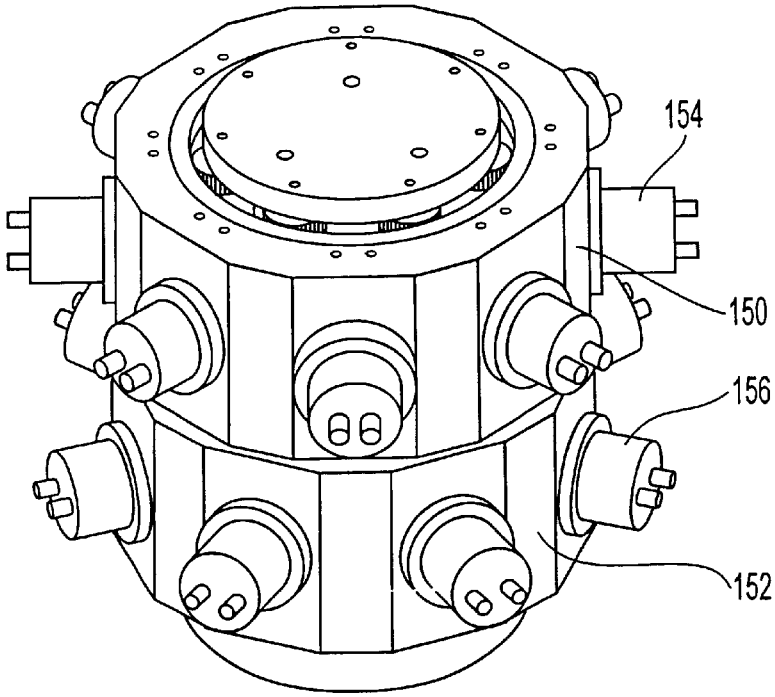
FIG. 5 is a perspective view of a double-stacked preferred embodiment power unit in accordance with the present invention.

In the assembled position, which may be configured out of the upper segment in FIG. 5, geared portions 116 of rollers 110 are engaged within the geared ring 102.

A speed reducing planetary gear train 120 is fitted into the housing and comprises a sun gear 122, three planetary gears 124, a gear ring 126, a top support plate 128 formed with apertures 129 and a bottom plate 130 fitted with axles 132 for mounting thereon the planetary gears 124.

A shaft 134 extends through the bottom plate 130 and engages with the sun gear 122. Shaft 134 is supported by a bearing 136.

Housing 106 is formed with a plurality of bores 140 each fitted with a cylinder module generally designated 142 which, as explained hereinabove, may either be a pumping/compressing module.

In the assembled position, rotary motion is imparted via shaft 134 and speed is reduced by the speed reducing assembly 120. Top plate 128 is coupled with bottom plate 114 of the nodular rotor 108 by means of pins (not seen) extending into holes 129 of plate 128.

Rotation of plate 114 entails also rotation of plate 112 and also rotation of rollers 110. However, the engagement of rollers 110 within gearing 102 generates rotary motion of the rollers 110 also about their supporting axis.

This arrangement ensures that as the rollers engage with the bottom surface of the piston actuating member, radial thrust forces are eliminated or essentially reduced as well as friction forces.

Referring now to FIG. 5 of the drawings there is illustrated a double-stacked power unit in accordance with the present invention comprising two housing 150 and 152 coaxially mounted on top one another. Each of the housings 150 and 152 is principally similar to the embodiment shown in the exploded view of FIG. 4. However, it will be appreciated that housing 150 is devoid of speed reducing assembly 120. Pins (not seen) projecting from the plate 114 of the top housing 150 project into plate 112 of housing 152 whereby rotary motion is transferred between the associated housings.

Figure 4:
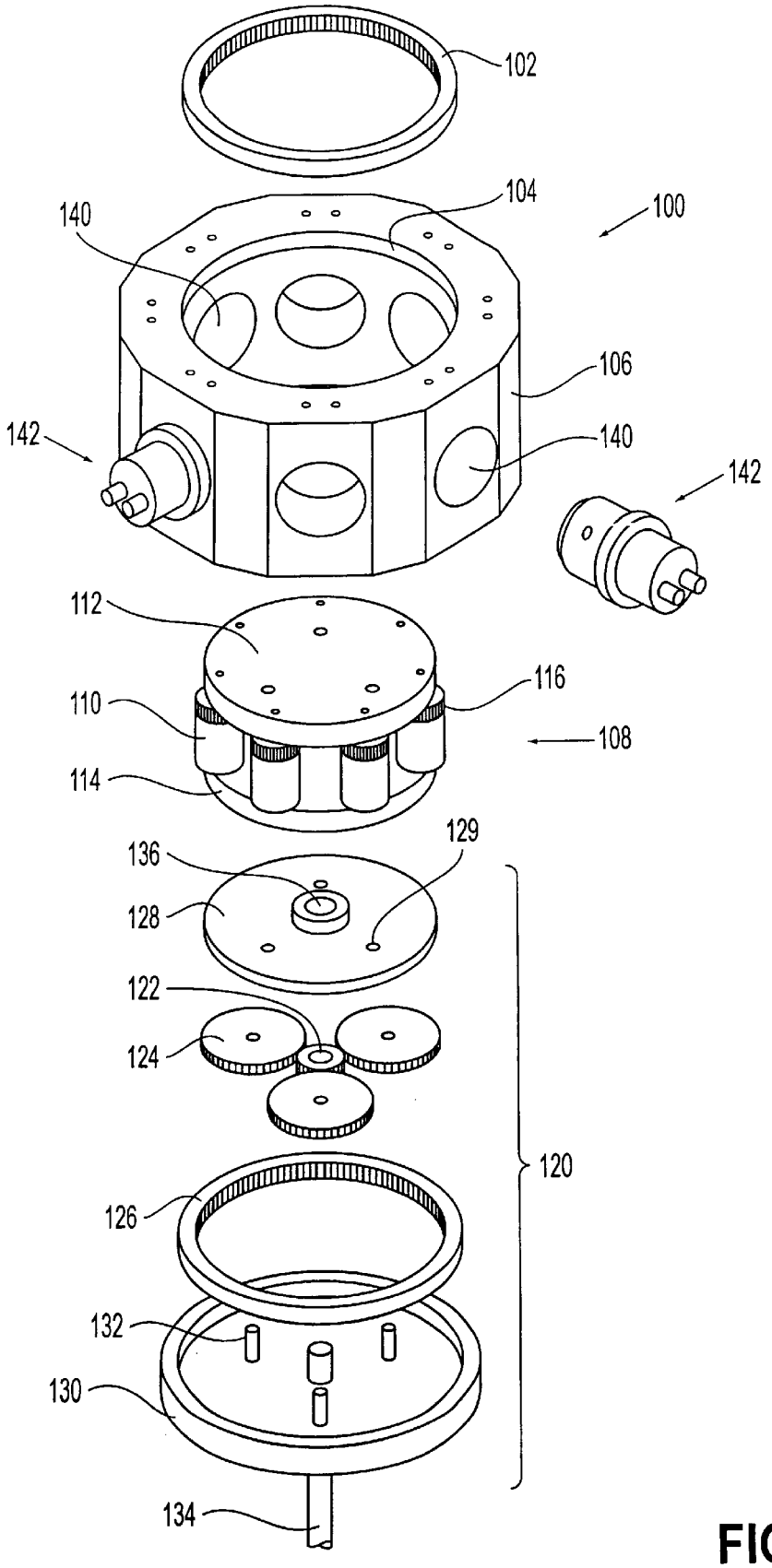
FIG. 4 is an exploded, perspective view of a power unit, in accordance with a second, preferred embodiment of the present invention.

In this embodiment, the shaft 134 seen in FIG. 4 may be eliminated wherein one housing, for example housing 152, may be designed as an engine whereas housing 150 may be designed as a pump/compressor, the entire power unit being self contained, with rotary displacement between housings being transferred by the nodular rotor assemblies.

Figure 6:
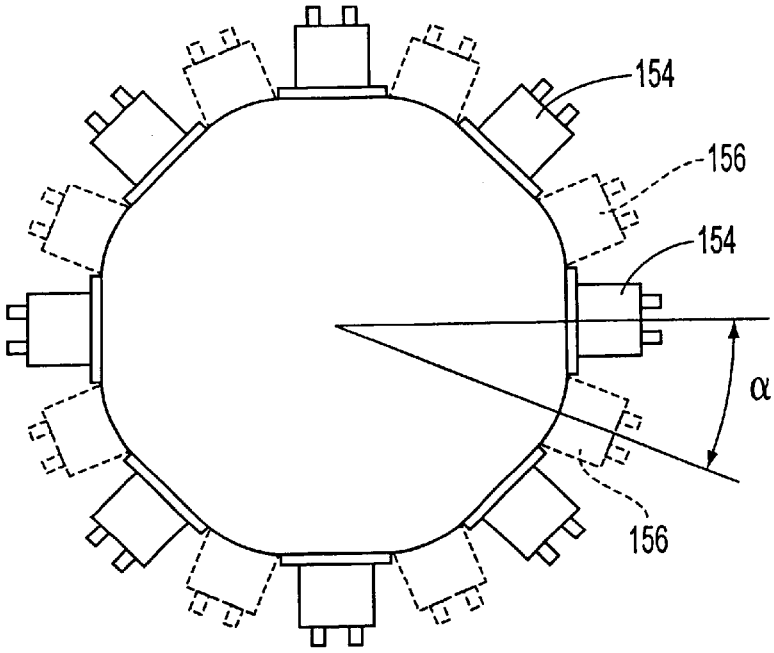
FIG. 6 is a schematical top view of the embodiment seen in FIG. 5, illustrating the angular offset of the piston centers.

FIG. 6 is a schematic top view of the embodiment seen in FIG. 5, wherein it is shown that the angular set-off between pistons 154 of housing 150 and pistons 156 of housing 152 is calculated by the formula $$\alpha^\circ = (360/N)/p$$

wherein:

$\alpha$ is measured in degrees;

N is the number of cylinders in each plane; and

P is the number of planes.

In the present example, P=8 and P=2 and the angle $\alpha$ is thus = to 22.5°.

Figure 7:
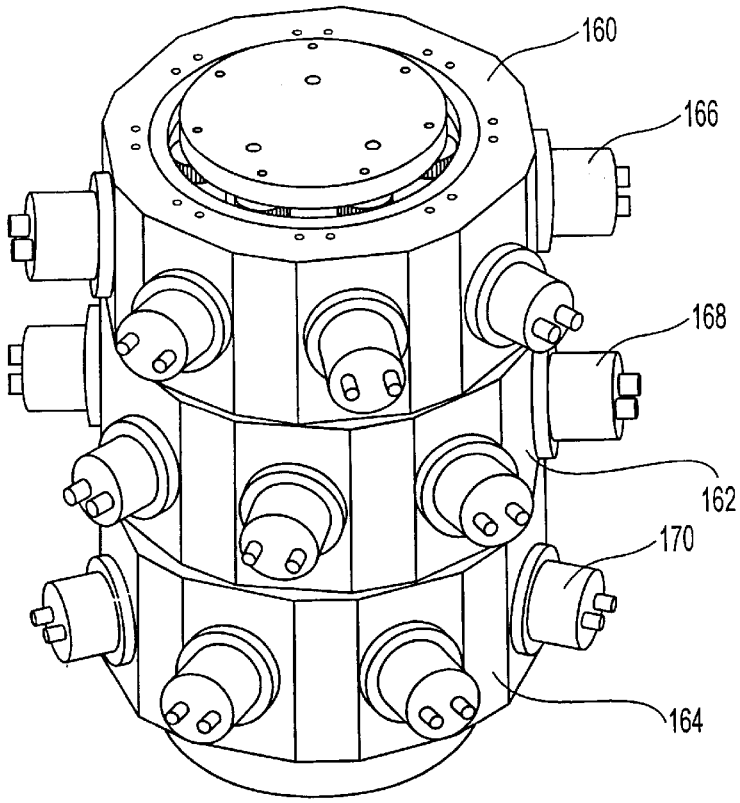
FIG. 7 illustrates a triple-stacked power unit in accordance with a preferred embodiment of the present invention.

In the embodiment of FIG. 7 there is illustrated a triple-stacked power unit comprising three housings 160, 162 and 164, each fitted with a plurality of piston modules 166, 168 and 170, respectively.

The arrangement in this embodiment is essentially similar to the embodiment of FIG. 5 as far as transferring rotational motion and with respect to the offset of the centers of the pistons in the three layers.

This arrangement is suitable in particular, but not limited thereto, to pumping/compressing power units wherein successive displacement of the pistons is obtained, ensuring smooth operation and continuous compression or suction force. Alternatively, the housings may be arranged so as to operate in tandem.

Figure 8:
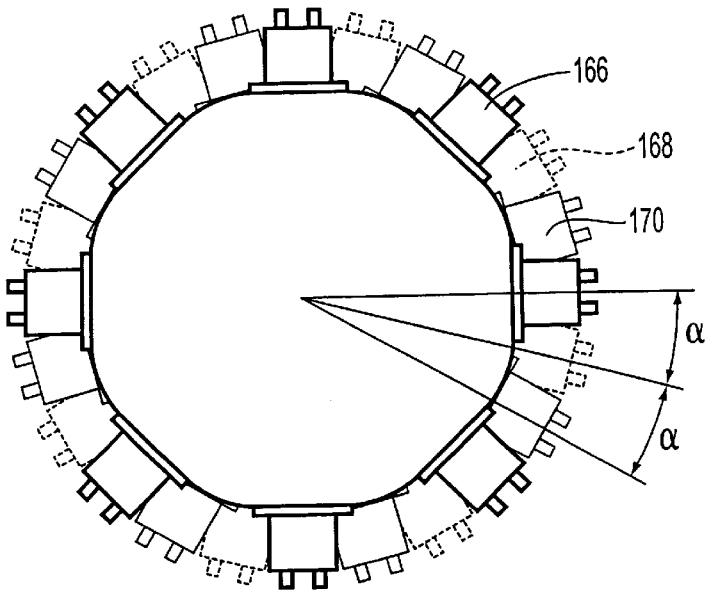
FIG. 8 is a top schematic representation of the embodiment seen in FIG. 7, illustrating the offset of the pistons.

FIG. 8 illustrates the radial offset position of the centers of the piston modules which based on the formula referred to in connection with FIG. 6, yields a different angle $\alpha=15°$.

In the embodiment of FIG. 7, each of the housings may accommodate different piston modules. By one example, the stacked power unit may be designed so that one housing is an engine, a second housing is a compressor and a third housing is a pump. However, a variety of other combinations are also possible.

Having provided the above description, some further clarifications and highlighting are to be added. For example, it is pointed out that the nodular rotor in accordance with any of the above embodiments is rotational in both directions without having to perform any changes in the assembly prior to changing direction of rotation. Obviously, this is an advantage also as far as flexibility in connecting the pump/compressor to an output of an engine.

Furthermore, as noted, no particular lubricating means are provided apart from the use of PTFE piston rings for friction reducing. This fact in itself, avails the pump/compressor for use in particular, but not restricted thereto, with different gasses, e.g. oxygen for medical supply, different gasses for scuba diving, and gasses for industrial processes. Typically, in such instances, the compressed gasses are required at high degrees of purification. It will, however, be noted that a variety of other lubricating composites may be used as well as other lubricating means, such as liquid oil lubrication, as known in the art.

While in the embodiments described hereinabove, a planetary speed reducing gear was integrally provided within the power unit, it is to be understood that such a speed reducing mechanism may be eliminated or may be incorporated as an independent assembly linked between the power unit and an engine providing rotary motion. It will also be appreciated that such speed reducing means may be of any particular design and are not necessarily restricted to planetary gears although, it will be understood that planetary speed reducing gears have the significant advantage of being compact and thus suitable for incorporation within the housing of the power unit of the present invention.

As already mentioned above, the cylinder modules are entirely modular and interchangeable. This is considered as a significant advantage providing flexibility wherein a single plane power unit may be designed with some cylinder modules adapted to perform pumping or compressing and other cylinder modules adapted to generate rotary motion, whereby the power unit is self contained.

It is also appreciated that the pump/compressor in accordance with the present invention is suitable for simultaneously pumping or compressing different media wherein some of the cylinder modules may be used to pump or compress a first type of fluid and other piston modules may serve for pumping or compressing another media of fluid. Such fluids may be either liquids or gasses, as the artisan will no doubt realize.

As illustrated and described above, the power units may be designed for stacking on top of one another with integral means provided for transferring rotary motion between levels of the power units. This again, is an advantage as far as modularity is concerned, wherein each plane may be designed to perform a different type of work, i.e., pumping, compressing or generate work (serve as an engine). Alternatively, it is appreciated that rather than stacking several housings on top of one another, there may be a single housing provided with several planes of bores, each plane serving as a different functional unit.

It is further appreciated that failing of one or more cylinder modules or removal of a cylinder module does not influence the functional operation of the remaining cylinder modules, each one of which being independently operable.

It is further desired to emphasize that the structure of the power unit in accordance with any of the above described embodiments is designed to have a rotational speed of approximately 300 RPM. This is considered as a great advantage over prior art power units which typically operate at a significantly higher rotational speed in order to deliver the same work, thus significantly improving the overall efficiency of the power unit.

By utilizing an extreme ratio piston diameter to stroke, typically in the order of greater than about 5:1, the power unit in accordance with the present invention achieves reducing of linear speed of the piston within the cylinder. This is a significant advantage resulting in reduction of friction, ring wear, cylinder wall wear, less heat generation and reduced load on the drive train, as well as a quieter operation.

These improved qualities permit the usage of such materials which otherwise could not be used in such power units. Such materials are, for example, composite plastics, light metals, etc. The advantage of using such materials resides in reducing frictional losses between piston rings and cylinder walls and the elimination of the stick/slip phenomena, which is inherent in metal contact surfaces. This arrangement also allows the short stroke compressor to operate without liquid lubrication (oil-free) and thus significantly reducing the overall size and weight of the unit.

Whilst some preferred embodiments have been shown and described in the specification, it will be understood by an artisan that it is not intended thereby to delimit the disclosure of the invention, but rather it is intended to cover all modifications and arrangements falling within the scope and the spirit of the present invention as defined in the appended claims, mutatis mutandis.

What is claimed is:

1. A rotary power unit (10), comprising:

a housing (22) having an circular opening (24) and a plurality of bores (28), each extending along a radial axis from a center of said opening (24), a nodular rotor (52) mounted within the opening (24) of the housing (22) and coaxially rotatable within the opening (24); said nodular rotor (52) comprising a plurality of nodes (58) equally distributed along the bounding circle thereof, a plurality of replaceable cylinder modules (70), each fixedly receivable within a respective bore (28) within the housing (22);

each cylinder module (70) comprising a piston (72) slidable within a cylinder (74), a piston actuating member (78) associated with each piston (72) having a bottom surface geometrically shaped to produce a predetermined up-stroke and down-stroke operation, and a work unit associated with a cylinder head (88) at a distal end of the cylinder (74); each piston (72) being displaceable during an up-stroke and down-stroke operation along the radial axis between a Top Dead Center (TDC) and a Bottom Dead Center (BDC), the pistons being biased into said BDC;

and wherein the nodular rotor (52) is fitted at each node with a radial thrust reducing roller (60) for engagement with the bottom surface of the respective piston actuating members (78) to effect a desired operation.

2. A rotary power unit according to claim 1 wherein a bottom surface (80) of the piston actuators (78) is either flat or concave or convex or has a complex shape comprising a combination of flat and arcuate segments.

3. A rotary power unit according the claim 2 wherein the stroke displacements and dwell time at the TDC of the piston (72) is determined by the geometry of the bottom surface (80) of the piston actuator (78).

4. A rotary power unit according to claim 3 wherein the dwell angle d of the piston at the BDC, measured in degrees of rotor (52) rotation, is calculated by the formula:

$$d \geqq (360°/n)*0.125$$

where:

d is the dwell angle measured in degrees; and n in the number of nodes.

5. A rotary power unit according to claim 1 wherein the piston (72) is at the TDC when a corresponding node (58) of the nodular rotor (52) extends along the respective radial axis; and the piston (58) is at its BDC when the respective node (52) is angularly displaced by (180°/n)-d/2 from said radial axis; wherein:

n—is the number of nodes of the nodular rotor, and d—is the dwell angle between neighboring cylinders (measured in degrees).

6. A rotary power unit according to claim 1 wherein the nodular rotor (52) is associated with a shaft (36) extending from the center of and perpendicular to the place of the nodular rotor (52) and adapted for receiving or imparting rotary motion to or from the nodular rotor, alternatively.

7. A rotary power unit according the claim 1 wherein the work unit (88) is an assembly comprising one or more inlet valves (90) and one or more outlet (92) valves, and wherein rotary motion is imparted to the nodular rotor (52) entailing radial displacement of the piston (72), thereby establishing a pump or compressor.

8. A rotary power unit according to claim 1, wherein the work unit is an assembly comprising a fuel supply nozzle, ignition and ignition timing arrangements, and gas exchange passages; wherein radial displacement of the pistons imparts rotary motion to the nodular rotor, thereby establishing a radial engine.

9. A rotary power unit according to claim 1 wherein the work unit of some of the cylinder modules is an assembly comprising one or more inlet valves and one or more outlet valves; and the work unit of the remaining cylinder modules is an assembly comprising a fuel supply nozzle, an ignition member and gas exchange passages.

10. A rotary power unit according to claim 1, wherein the number of bores (38) is an even number.

11. A rotary power unit (100) according claim 1 wherein the nodular rotor (108) is associated with a speed reducing assembly (120).

12. A rotary power unit according to claim 11, wherein the speed reducing assembly (120) is a planetary gear train, said planetary gear trim comprising a sun gear (122) fixed to the shaft (134), at least one planet gear (124) rotatably supported by the housing and a ring gear (126) associated with the nodular rotor (108).

13. A rotary power unit according the claim 11 wherein the speed reducing assembly (120) is a planetary gear trim, said planetary gear trim comprising a sun gear (122) fixed to the shaft (134), at least one planet gear (124) rotatably fixed to the nodular rotor (108), and a ring gear (126) fixed to the housing (106).

14. A rotary power unit according to claim 1 wherein the piston actuating member (78) is integral with or rigidly fixed to the piston (72), and has a bottom surface (80) for engagement with the nodes of the nodular rotor.

15. A rotary power unit according to claim 1 wherein the radial distance between the piston (72) and the piston actuator (78) is adjustable, thus adjusting clearance of the piston within the cylinder.

16. A rotary power unit according to claim 2 wherein the curvature ratio between the diameter of the opening in the housing (24) and a theoretical spherical diameter of the convex or the concave surface (80) is in the order of about 1:1 to about 1:4.

17. A rotor power unit according to 1 wherein the radial thrust reducing arrangement is a roller (60) fitted at each node (58), each roller (60) being rotatable about an axle parallel to an axis (36) of rotation of the nodular rotor (52).

18. A rotary power unit according to claim 1 wherein the radial thrust reducing arrangement is a roller (110) having a geared portion (116) fitted on each node for engagement with a geared ring (102) fixed within the opening of the housing (106), thus imparting the rollers (110) positive rotation about their longitudinal axis.

19. A rotary power unit according to claim 1 wherein the cylinder modules (70:142) are rotationally restrained within their bores.

20. A rotary unit according to claim 1 wherein sealing rings (76) are provided on the piston (72).

21. A rotary power unit according to claim 1 wherein rider rings (84) are provided on the actuating member (78) slidable within a positioning sleeve fixed with respect to the bore (28).

22. A rotary power unit according to claim 1 wherein the piston (72) and the piston actuating member (78) have different diameters, whereby a cylindrical insert is used as an adapter between the diameter of the piston or of the piston actuating member and the diameter of the bore (28).

23. A rotary power unit according to claim 1 wherein the opening within the housing comprises a plurality of bores arranged in two or more parallel planes; each bore extending along a radial axis from said opening.

24. A rotary power unit according to claim 1 wherein two or more housings (150; 152; 160; 164) are coaxially stacked on top of one another in parallel planes, whereby rotary motion is transferred between nodular rotors of neighboring housings.

25. A rotary power unit according to claim 1 wherein the nodular rotor (52) is adapted for both clockwise and counterclockwise rotation.

26. A rotary power unit according to claim 1 wherein the piston (72) has a diameter to stroke ratio being greater than or equal to about 5:1.

27. A rotary power unit according to claim 4 wherein the nodular rotor (52) is rotated at about 300 RPM, or less.

28. A rotary power unit according to claim 23, wherein the centers of bores in one plane are radially offset with respect to centers of bores in a neighboring plane by $\alpha°$, wherein $\alpha$ is derived out of the formula:

$$\alpha^{\circ}=(360/N)/p$$

wherein:

$\alpha$ is measured in degrees;

N is the number of cylinders in each plane; and

P is the number of planes.

29. A rotary power unit according to claim 23 wherein one or more planes are dedicated to establishing a pump or compressor and one or more other planes are dedicated to establish a radial engine.

30. A rotary power assembly comprising two or more rotary power units according to claim 32, fixedly and coaxially attached to one another.

31. A rotary power unit according to claim 1 wherein some of the bores comprise one or more inlet valves and one or more outlet valves, and remaining bores are fitted with a fuel supply nozzle, ignition and ignition timing arrangements, and gas exchange passages, whereby a combined radial engine and a pump or compressor is established.

* * * * *